US009401534B2

(12) United States Patent
Kato et al.

(10) Patent No.: US 9,401,534 B2
(45) Date of Patent: Jul. 26, 2016

(54) HIGH-FREQUENCY SIGNAL LINE AND ELECTRONIC DEVICE

(71) Applicant: Murata Manufacturing Co., Ltd., Nagaokakyo-shi, Kyoto-fu (JP)

(72) Inventors: Noboru Kato, Nagaokakyo (JP); Shigeru Tago, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 218 days.

(21) Appl. No.: 14/193,106

(22) Filed: Feb. 28, 2014

(65) Prior Publication Data

US 2014/0176266 A1 Jun. 26, 2014

Related U.S. Application Data

(63) Continuation of application No. PCT/JP2012/082042, filed on Dec. 11, 2012.

(30) Foreign Application Priority Data

Dec. 22, 2011 (JP) ..... 2011-281384

(51) Int. Cl.
*H01P 3/08* (2006.01)

(52) U.S. Cl.
CPC *H01P 3/088* (2013.01); *H01P 3/08* (2013.01); *H01P 3/085* (2013.01)

(58) Field of Classification Search
CPC ..... H01P 3/08
USPC ..... 333/238, 246, 33
See application file for complete search history.

(56) References Cited

U.S. PATENT DOCUMENTS

| | | | |
|---|---|---|---|
| 5,631,446 | A | 5/1997 | Quan |
| 6,577,211 | B1 | 6/2003 | Tsujiguchi |
| 2014/0176264 | A1 | 6/2014 | Tago et al. |

FOREIGN PATENT DOCUMENTS

| | | | |
|---|---|---|---|
| JP | 5-68102 | U | 9/1993 |
| JP | 6-188603 | A | 7/1994 |
| JP | 2000-91801 | A | 3/2000 |
| JP | 2001-28506 | A | 1/2001 |
| JP | 2011-071403 | A | 4/2011 |
| JP | 3173143 | U | 1/2012 |
| JP | 5574056 | B2 | 8/2014 |
| JP | 5672128 | B2 | 2/2015 |

OTHER PUBLICATIONS

Official Communication issued in corresponding Japanese Patent Application No. 2015-058006, mailed on Apr. 28, 2015.
Official Communication issued in International Patent Application No. PCT/JP2012/082042, mailed on Mar. 26, 2013.
Official Communication issued in corresponding Japanese Patent Application No. 2013-550232, mailed on Nov. 11, 2014.

*Primary Examiner* — Stephen E Jones
(74) *Attorney, Agent, or Firm* — Keating & Bennett, LLP

(57) ABSTRACT

A high-frequency signal line includes an element assembly including a plurality of flexible insulator layers, a linear signal line provided in or on the element assembly, a first ground conductor arranged in or on the element assembly so as to be opposed to the signal line not in a first section including a portion of the signal line but in a second section adjacent to the first section, and a second ground conductor provided along the signal line in the first section on the insulator layer on which the signal line is provided. The second ground conductor is not opposed at least in part to the first ground conductor in the first section.

20 Claims, 12 Drawing Sheets

HIGH-FREQUENCY SIGNAL LINE AND ELECTRONIC DEVICE

This application is based on International Application No. PCT/JP2012/082042 filed on Dec. 11, 2012, and Japanese Patent Application No. 2011-281384 filed on Dec. 22, 2011, the entire content of each of which is incorporated herein by reference.

BACKGROUND OF THE INVENTION

1. Field of the Invention

The present invention relates to high-frequency signal lines and electronic devices, more particularly to a high-frequency signal line including a signal line provided on a flexible element assembly, and an electronic device including the high-frequency signal line.

2. Description of the Related Art

As a high-frequency line for connecting high-frequency circuits, a coaxial cable is typically used. Coaxial cables are widely used because they can be deformed, e.g., bent, easily, and are inexpensive.

Incidentally, recent years have seen high-frequency devices, such as mobile communications terminals, becoming more compact. Accordingly, it is becoming more difficult to keep space in high-frequency devices for disposing coaxial cables having circular cross sections.

Accordingly, there is a signal line proposed by Japanese Patent Laid-Open Publication No. 2011-71403. The signal line disclosed in Japanese Patent Laid-Open Publication No. 2011-71403 includes a signal line and two ground conductors provided in a body formed by laminating a plurality of insulating sheets made of a flexible material. The signal line is provided between the two ground conductors disposed on opposite sides in the direction of lamination. That is, the signal line and the two ground conductors form a stripline structure. The thickness of such a signal line in the direction of lamination is less than the diameter of a typical coaxial cable. Therefore, the signal line can be accommodated in a small space where a typical coaxial cable cannot be placed.

However, there is difficulty in bending the signal line disclosed in Japanese Patent Laid-Open Publication No. 2011-71403 when in use. The ground conductors used in the signal line are made of copper foil resistant to deformation. Accordingly, when a strong force is applied to the ground conductors by bending the signal line, the ground conductors might be broken.

SUMMARY OF THE INVENTION

A high-frequency signal line according to a preferred embodiment of the present invention includes an element assembly including a plurality of flexible insulator layers; a linear signal line provided in or on the element assembly; a first ground conductor provided in or on the element assembly, so as to be opposed to the signal line not in a first section including a portion of the signal line but in a second section adjacent to the first section; and a second ground conductor provided along the signal line in the first section on the insulator layer on which the signal line is provided. The second ground conductor is not opposed at least in part to the first ground conductor in the first section.

An electronic device according to another preferred embodiment of the present invention includes a housing, and a high-frequency signal line accommodated in the housing. The high-frequency signal line includes an element assembly including a plurality of flexible insulator layers, a linear signal line provided in or on the element assembly, a first ground conductor provided in or on the element assembly, so as to be opposed to the signal line not in a first section including a portion of the signal line but in a second section adjacent to the first section, and a second ground conductor provided along the signal line in the first section on the insulator layer on which the signal line is provided. The second ground conductor is not opposed at least in part to the first ground conductor in the first section.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a high-frequency signal line according to preferred embodiments of the present invention, along with an electronic device including the signal line, will be described with reference to the drawings.

Figure 1:
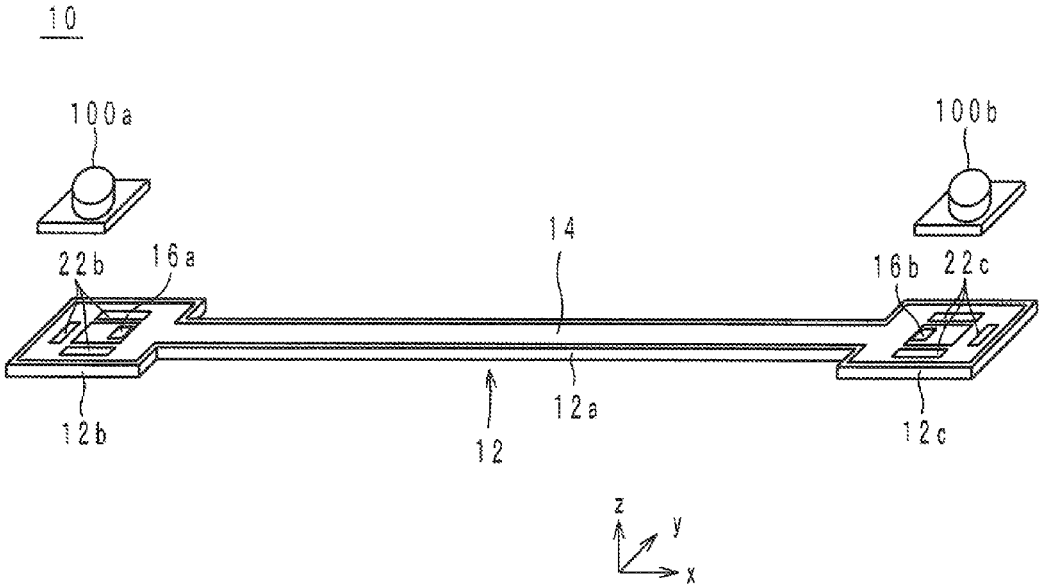
FIG. 1 is an external oblique view of a high-frequency signal line according to a preferred embodiment of the present invention.
Figure 2:
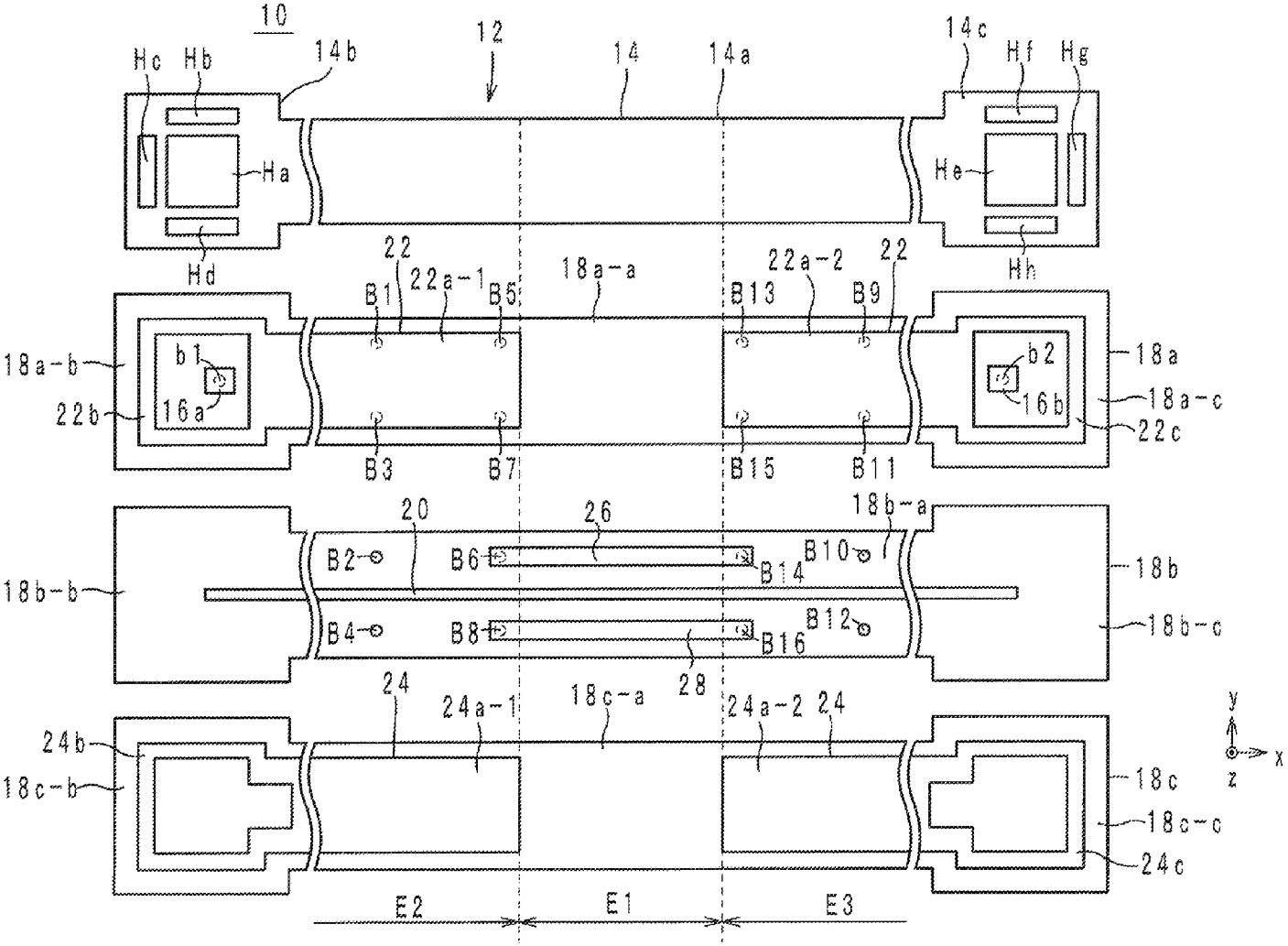
FIG. 2 is an exploded view of a dielectric element assembly of the high-frequency signal line in FIG. 1.
Figure 3:
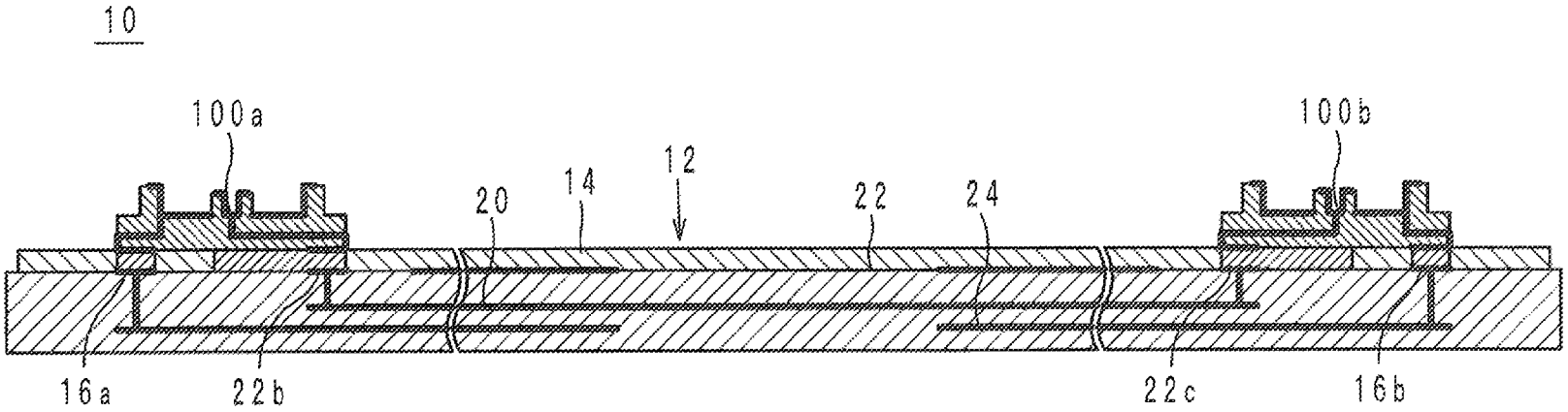
FIG. 3 is a cross-sectional structure view of the high-frequency signal line in FIG. 1.
Figure 4:
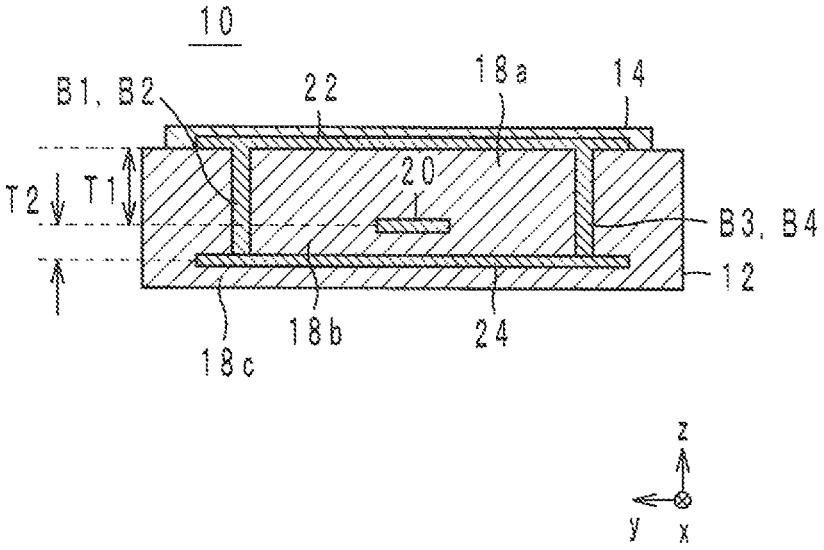
FIG. 4 is another cross-sectional structure view of the high-frequency signal line.
Figure 5A:
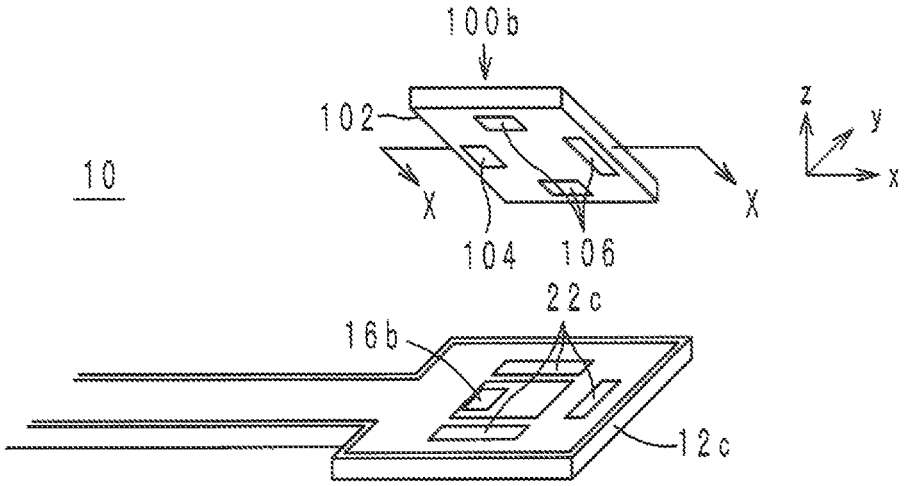
FIG. 5A is an external oblique view of a connector of the high-frequency signal line.
Figure 5B:
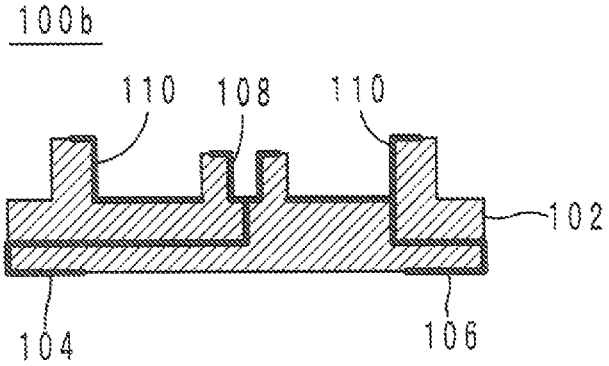
FIG. 5B is a cross-sectional structure view of the connector of the high-frequency signal line.

The configuration of the high-frequency signal line according to a preferred embodiment of the present invention will be described below with reference to the drawings. FIG. 1 is an external oblique view of the high-frequency signal line 10 according to a preferred embodiment of the present invention. FIG. 2 is an exploded view of a dielectric element assembly 12 of the high-frequency signal line 10 in FIG. 1. FIG. 3 is a cross-sectional structure view of the high-frequency signal line 10 in FIG. 1. FIG. 4 is another cross-sectional structure view of the high-frequency signal line 10. FIG. 5A is an external oblique view of a connector 100*b* of the high-frequency signal line 10. FIG. 5B is a cross-sectional structure view of the connector 100*b*. In FIGS. 1 through 5, the direction of lamination of the high-frequency signal line 10 will be defined as a z-axis direction. Moreover, the longitudinal direction of the high-frequency signal line 10 will be defined as an x-axis direction, and the direction perpendicular to the x-axis and z-axis directions will be defined as a y-axis direction.

The high-frequency signal line 10 is used in, for example, an electronic device such as a cell phone, to connect two high-frequency circuits. The high-frequency signal line 10 preferably includes the dielectric element assembly 12, external terminals 16 (16*a* and 16*b*), a signal line 20, ground conductors 22, 24, 26, and 28, via-hole conductors b1, b2, and B1 to B16, a connector 100*a*, and the connector 100*b*, as shown in FIGS. 1 through 3.

The dielectric element assembly 12, when viewed in a plan view in the z-axis direction, extends in the x-axis direction, and includes a line portion 12*a*, and connecting portions 12*b* and 12*c*. The dielectric element assembly 12 is a laminate preferably formed by laminating a protective layer 14 and dielectric sheets (insulator layers) 18 (18*a* to 18*c*) in this order, from the positive side to the negative side in the z-axis direction, as shown in FIG. 2. In the following, the principal surface of the dielectric element assembly 12 that is located on the positive side in the z-axis direction will be referred to as a top surface (first principal surface), and the principal surface of the dielectric element assembly 12 that is located on the negative side in the z-axis direction will be referred to as a bottom surface (second principal surface).

The line portion 12*a* extends in the x-axis direction. The connecting portion 12*b* has a rectangular or substantially rectangular shape connected to the end of the line portion 12*a* on the negative side in the x-axis direction, and the connecting portion 12*c* has a rectangular or substantially rectangular shape connected to the end of the line portion 12*a* on the positive side in the x-axis direction. The width of each of the connecting portions 12*b* and 12*c* in the y-axis direction is greater than the width of the line portion 12*a* in the y-axis direction.

The dielectric sheets 18, when viewed in a plan view in the z-axis direction, extend in the x-axis direction, and have the same shape as the dielectric element assembly 12. The dielectric sheets 18 are made of a flexible thermoplastic resin such as polyimide or liquid crystal polymer. The thickness T1 of the dielectric sheet 18*a* is greater than the thickness T2 of the dielectric sheet 18*b*, as shown in FIG. 4. For example, the thickness T1 preferably is about 50 μm to about 300 μm, for example, after lamination of the dielectric sheets 18*a* to 18*c*. In the present preferred embodiment, the thickness T1 preferably is about 150 μm, for example. Moreover, the thickness T2 preferably is about 10 μm to about 100 μm, for example. In the present preferred embodiment, the thickness T2 preferably is about 50 μm, for example. In the following, the principal surface of each of the dielectric sheets 18 that is located on the positive side in the z-axis direction will be referred to as a top surface, and the principal surface of each of the dielectric sheets 18 that is located on the negative side in the z-axis direction will be referred to as a bottom surface.

Furthermore, the dielectric sheet 18*a* includes a line portion 18*a-a* and connecting portions 18*a-b* and 18*a-c*. The dielectric sheet 18*b* includes a line portion 18*b-a* and connecting portions 18*b-b* and 18*b-c*. The dielectric sheet 18*c* includes a line portion 18*c-a* and connecting portions 18*c-b* and 18*c-c*. The line portions 18*a-a*, 18*b-a*, and 18*c-a* constitute the line portion 12*a*. The connecting portions 18*a-b*, 18*b-b*, and 18*c-b* constitute the connecting portion 12*b*. The connecting portions 18*a-c*, 18*b-c*, and 18*c-c* constitute the connecting portion 12*c*.

The external terminal 16*a* is a rectangular or substantially rectangular conductor provided near the center of the top surface of the connecting portion 18*a-b*, as shown in FIGS. 1 and 2. The external terminal 16*b* is a rectangular or substantially rectangular conductor provided near the center of the top surface of the connecting portion 18*a-c*, as shown in FIGS. 1 and 2. The external terminals 16*a* and 16*b* are made of a metal material mainly composed of silver or copper and having a low specific resistance. In addition, the top surfaces of the external terminals 16*a* and 16*b* are preferably plated with gold.

The signal line 20 is a linear conductor provided in the dielectric element assembly 12 and extending on the top surface of the dielectric sheet 18*b* in the x-axis direction, as shown in FIG. 2. The signal line 20, when viewed in a plan view in the z-axis direction, overlaps with the external terminals 16*a* and 16*b* at opposite ends. The width of the signal line 20 preferably is, for example, about 100 μm to about 500 μm. In the present preferred embodiment, the width of the signal line 20 preferably is about 240 μm, for example. The signal line 20 is made of a metal material mainly composed of silver or copper and having a low specific resistance.

Here, the dielectric element assembly 12 is divided into three sections E1 to E3. The section E1 includes a portion of the signal line 20 and extends along the signal line 20 in the x-axis direction. The sections E2 and E3 are positioned on opposite sides of the section E1 in the x-axis direction. The section E2 is adjacent to the section E1 on the negative side in the x-axis direction, and extends along the signal line 20 in the x-axis direction. The section E3 is adjacent to the section E1 on the positive side in the x-axis direction, and extends along the signal line 20 in the x-axis direction.

The ground conductor 22 (first ground conductor) is provided in the dielectric element assembly 12 on the positive side in the z-axis direction relative to the signal line 20, as shown in FIG. 2, and more specifically, the ground conductor 22 is provided on the top surface of the dielectric sheet 18*a*, which is closest to the top surface of the dielectric element assembly 12. The ground conductor 22 extends along the top surface of the dielectric sheet 18*a* in the x-axis direction, and is opposed to the signal line 20 with the dielectric sheet 18*a* positioned therebetween. The ground conductor 22 is made of a metal material mainly composed of silver or copper and having a low specific resistance.

Furthermore, the ground conductor 22 includes line portions 22*a*-1 and 22*a*-2 and terminal portions 22*b* and 22*c*. The line portion 22*a*-1 is provided on the top surface of the line portion 18*a-a* in the section E2, and extends in the x-axis direction. Accordingly, the line portion 22*a*-1 is opposed to the signal line 20 in the section E2. The line portion 22*a*-2 is provided on the top surface of the line portion 18*a-a* in the section E3, and extends in the x-axis direction. Accordingly, the line portion 22*a*-2 is opposed to the signal line 20 in the section E3. Moreover, the ground conductor 22 does not have any portions provided in the section E1. Therefore, the ground conductor 22 is not opposed to the signal line 20 in the section E1.

The terminal portion 22*b* is provided on the top surface of the connecting portion 18*a-b*, in the form of a rectangular or substantially rectangular rim around the external terminal 16*a*. The terminal portion 22*b* is connected to the end of the line portion 22*a*-1 on the negative side in the x-axis direction.

The terminal portion 22*c* is provided on the top surface of the connecting portion 18*a*-*c*, in the form of a rectangular or substantially rectangular rim around the external terminal 16*b*. The terminal portion 22*c* is connected to the end of the line portion 22*a*-2 on the positive side in the x-axis direction.

The ground conductor 24 (fourth ground conductor) is provided in the dielectric element assembly 12 on the negative side in the z-axis direction relative to the signal line 20, as shown in FIG. 2, and more specifically, the ground conductor 24 is provided on the top surface of the dielectric sheet 18*c*. Accordingly, the ground conductor 24 is positioned between the dielectric sheets 18*b* and 18*c*. The ground conductor 24 extends along the top surface of the dielectric sheet 18*c* in the x-axis direction, and is opposite to the signal line 20 with the dielectric sheet 18*b* positioned therebetween. That is, the ground conductor 24 is opposite to the ground conductor 22 with the signal line 20 positioned therebetween. The ground conductor 24 is made of a metal material mainly composed of silver or copper and having a low specific resistance.

Furthermore, the ground conductor 24 includes line portions 24*a*-1 and 24*a*-2 and terminal portions 24*b* and 24*c*. The line portion 24*a*-1 is provided on the top surface of the line portion 18*c*-*a* in the section E2, and extends in the x-axis direction. Accordingly, the line portion 24*a*-1 is opposed to the signal line 20 in the section E2. The line portion 24*a*-2 is provided on the top surface of the line portion 18*c*-*a* in the section E3, and extends in the x-axis direction. Accordingly, the line portion 24*a*-2 is opposed to the signal line 20 in the section E3. Moreover, the ground conductor 24 does not have any portions provided in the section E1. Therefore, the ground conductor 24 is not opposed to the signal line 20 in the section E1.

The terminal portion 24*b* is provided on the top surface of the connecting portion 18*c*-*b*, and has the same shape as the terminal portion 22*b*. The terminal portion 24*b* is connected to the end of the line portion 24*a*-1 on the negative side in the x-axis direction. The terminal portion 24*c* is provided on the top surface of the connecting portion 18*c*-*c*, and has the same shape as the terminal portion 22*c*. The terminal portion 24*c* is connected to the end of the line portion 24*a*-2 on the positive side in the x-axis direction.

In this manner, the signal line 20 is positioned between the ground conductors 22 and 24, which are located on opposite sides in the z-axis direction, with the dielectric sheets 18*a* and 18*b* intervening therebetween. That is, the signal line 20 and the ground conductors 22 and 24 define a tri-plate stripline structure in each of the sections E2 and E3. Moreover, the distance between the signal line 20 and the ground conductor 22 is, for example, about 50 μm to about 300 μm, which is approximately equal to the thickness T1 of dielectric sheet 18*a*, as shown in FIG. 4. In the present preferred embodiment, the distance between the signal line 20 and the ground conductor 22 preferably is about 150 μm, for example. On the other hand, the distance between the signal line 20 and the ground conductor 24 preferably is, for example, about 10 μm to about 100 μm, which is approximately equal to the thickness T2 of the dielectric sheet 18*b*, as shown in FIG. 4. In the present preferred embodiment, the distance between the signal line 20 and the ground conductor 24 preferably is about 50 μm, for example. That is, the thickness T1 is designed to be greater than the thickness T2.

Since the thickness T1 is greater than the thickness T2, as described above, the value of the capacitance that is created between the ground conductor 22 and the signal line 20 becomes smaller, so that the width of the signal line 20 can be increased to achieve a predetermined impedance (e.g., about 50Ω). This results in a lower transmission loss, leading to enhanced electrical characteristics of the high-frequency signal line. In the present preferred embodiment, the capacitance between the ground conductor 22 and the signal line 20 is a main factor of impedance design, and the impedance of the ground conductor 24 is designed such that the ground conductor 24 serves to reduce signal radiation. Specifically, the ground conductor 22 and the signal line 20 set the characteristic impedance of the high-frequency signal line to be high (e.g., about 70Ω), and the ground conductor 24 is added to the high-frequency signal line in order to provide sections where the impedance is lower (e.g., about 30Ω), so that the impedance of the entire high-frequency signal line becomes a predetermined impedance value (e.g., about 50Ω).

The ground conductor 26 (second ground conductor) is provided on the top surface of the dielectric sheet 18*b* where the signal line 20 is provided, so as to extend along the signal line 20 in the section E1. More specifically, the ground conductor 26 is positioned on the top surface of the dielectric sheet 18*b* on the positive side in the y-axis direction relative to the signal line 20, and has an elongated shape extending parallel or substantially parallel to the signal line 20. Moreover, when viewed in a plan view in the z-axis direction, opposite ends of the ground conductor 26 in the x-axis direction are positioned in the sections E2 and E3 so as to overlap with the line portions 22*a*-1, 22*a*-2, 24*a*-1, and 24*a*-2. However, since the ground conductor 22 does not have any portions provided in the section E1, the ground conductor 26, when viewed in a plan view in the z-axis direction, is not opposed to the ground conductor 22 in the section E1.

The ground conductor 28 (third ground conductor) is provided on the top surface of the dielectric sheet 18*b* where the signal line 20 is provided, so as to extend along the signal line 20 in the section E1. More specifically, the ground conductor 28 is positioned on the top surface of the dielectric sheet 18*b* on the negative side in the y-axis direction relative to the signal line 20, and has an elongated shape extending parallel or substantially parallel to the signal line 20. Accordingly, the ground conductor 28 is opposite to the ground conductor 26 with the signal line 20 positioned therebetween. That is, the signal line 20 and the ground conductors 26 and 28 define a coplanar structure. Moreover, when viewed in a plan view in the z-axis direction, opposite ends of the ground conductor 28 in the x-axis direction are positioned in the sections E2 and E3 so as to overlap with the line portions 22*a*-1, 22*a*-2, 24*a*-1, and 24*a*-2. However, since the ground conductor 22 does not have any portions provided in the section E1, the ground conductor 28, when viewed in a plan view in the z-axis direction, is not opposed to the ground conductor 22 in the section E1.

The via-hole conductor b1 pierces through the connecting portion 18*a*-*b* of the dielectric sheet 18*a* in the z-axis direction, thus connecting the external terminal 16*a* to the end of the signal line 20 that is located on the negative side in the x-axis direction. The via-hole conductor b2 pierces through the connecting portion 18*a*-*c* of the dielectric sheet 18*a* in the z-axis direction, thus connecting the external terminal 16*b* to the end of the signal line 20 that is located on the positive side in the x-axis direction. As a result, the signal line 20 is connected between the external terminals 16*a* and 16*b*. The via-hole conductors b1 and b2 are made of a metal material mainly composed of silver or copper and having a low specific resistance.

The via-hole conductors B1 pierce through the line portion 18*a*-*a* in the section E2 in the z-axis direction, so as to be aligned at equal intervals in the x-axis direction (in FIG. 2, only one of them is shown). The via-hole conductors B1, when viewed in a plan view in the z-axis direction, are positioned on the positive side in the y-axis direction relative to the signal line 20. The via-hole conductors B2 pierce through the line portion 18*b*-*a* in the section E2 in the z-axis direction, so as to be aligned at equal intervals in the x-axis direction (in FIG. 2, only one of them is shown). The via-hole conductors B2, when viewed in a plan view in the z-axis direction, are positioned on the positive side in the y-axis direction relative to the signal line 20. The via-hole conductors B1 and B2 are connected to each other, such that each pair constitutes a single via-hole conductor, thus connecting the line portions 22*a*-1 and 24*a*-1. The via-hole conductors B1 and B2 are made of a metal material mainly composed of silver or copper and having a low specific resistance.

The via-hole conductors B3 pierce through the line portion 18*a*-*a* in the section E2 in the z-axis direction, so as to be aligned at equal intervals in the x-axis direction (in FIG. 2, only one of them is shown). The via-hole conductors B3, when viewed in a plan view in the z-axis direction, are positioned on the negative side in the y-axis direction relative to the signal line 20. The via-hole conductors B4 pierce through the line portion 18*b*-*a* in the section E2 in the z-axis direction, so as to be aligned at equal intervals in the x-axis direction (in FIG. 2, only one of them is shown). The via-hole conductors B4, when viewed in a plan view in the z-axis direction, are positioned on the negative side in the y-axis direction relative to the signal line 20. The via-hole conductors B3 and B4 are connected to each other, such that each pair constitutes a single via-hole conductor, thus connecting the line portions 22*a*-1 and 24*a*-1. The via-hole conductors B3 and B4 are made of a metal material mainly composed of silver or copper and having a low specific resistance.

The via-hole conductor B5 pierces through the line portion 18*a*-*a* in the section E2 in the z-axis direction, and, when viewed in a plan view in the z-axis direction, it is positioned on the positive side in the y-axis direction relative to the signal line 20. The via-hole conductor B5 electrically connects the line portion 22*a*-1 and the end of the ground conductor 26 that is located on the negative side in the x-axis direction. As a result, the ground conductors 22 and 26 are electrically connected.

The via-hole conductor B6 pierces through the line portion 18*b*-*a* in the section E2 in the z-axis direction, and, when viewed in a plan view in the z-axis direction, it is positioned on the positive side in the y-axis direction relative to the signal line 20. The via-hole conductor B6 electrically connects the line portion 24*a*-1 and the end of the ground conductor 26 that is located on the negative side in the x-axis direction. As a result, the ground conductors 24 and 26 are electrically connected.

The via-hole conductor B7 pierces through the line portion 18*a*-*a* in the section E2 in the z-axis direction, and, when viewed in a plan view in the z-axis direction, it is positioned on the negative side in the y-axis direction relative to the signal line 20. The via-hole conductor B7 electrically connects the line portion 22*a*-1 and the end of the ground conductor 28 that is located on the negative side in the x-axis direction. As a result, the ground conductors 22 and 28 are electrically connected.

The via-hole conductor B8 pierces through the line portion 18*b*-*a* in the section E2 in the z-axis direction, and, when viewed in a plan view in the z-axis direction, it is positioned on the negative side in the y-axis direction relative to the signal line 20. The via-hole conductor B8 electrically connects the line portion 24*a*-1 and the end of the ground conductor 28 that is located on the negative side in the x-axis direction. As a result, the ground conductors 24 and 28 are electrically connected.

The via-hole conductors B9 pierce through the line portion 18*a*-*a* in the section E3 in the z-axis direction, so as to be aligned at equal intervals in the x-axis direction (in FIG. 2, only one of them is shown). The via-hole conductors B9, when viewed in a plan view in the z-axis direction, are positioned on the positive side in the y-axis direction relative to the signal line 20. The via-hole conductors B10 pierce through the line portion 18*b*-*a* in the section E3 in the z-axis direction, so as to be aligned at equal intervals in the x-axis direction (in FIG. 2, only one of them is shown). The via-hole conductors B10, when viewed in a plan view in the z-axis direction, are positioned on the positive side in the y-axis direction relative to the signal line 20. The via-hole conductors B9 and B10 are connected to each other, such that each pair constitutes a single via-hole conductor, thus connecting the line portions 22*a*-2 and 24*a*-2. The via-hole conductors B9 and B10 are made of a metal material mainly composed of silver or copper and having a low specific resistance.

The via-hole conductors B11 pierce through the line portion 18*a*-*a* in the section E3 in the z-axis direction, so as to be aligned at equal intervals in the x-axis direction (in FIG. 2, only one of them is shown). The via-hole conductors B11, when viewed in a plan view in the z-axis direction, are positioned on the negative side in the y-axis direction relative to the signal line 20. The via-hole conductors B12 pierce through the line portion 18*b*-*a* in the section E3 in the z-axis direction, so as to be aligned at equal intervals in the x-axis direction (in FIG. 2, only one of them is shown). The via-hole conductors B12, when viewed in a plan view in the z-axis direction, are positioned on the negative side in the y-axis direction relative to the signal line 20. The via-hole conductors B11 and B12 are connected to each other, such that each pair constitutes a single via-hole conductor, thus connecting the line portions 22*a*-2 and 24*a*-2. The via-hole conductors B11 and B12 are made of a metal material mainly composed of silver or copper and having a low specific resistance.

The via-hole conductor B13 pierces through the line portion 18*a*-*a* in the section E3 in the z-axis direction, and, when viewed in a plan view in the z-axis direction, it is positioned on the positive side in the y-axis direction relative to the signal line 20. The via-hole conductor B13 electrically connects the line portion 22*a*-2 and the end of the ground conductor 26 that is located on the positive side in the x-axis direction. As a result, the ground conductors 22 and 26 are electrically connected.

The via-hole conductor B14 pierces through the line portion 18*b*-*a* in the section E3 in the z-axis direction, and, when viewed in a plan view in the z-axis direction, it is positioned on the positive side in the y-axis direction relative to the signal line 20. The via-hole conductor B14 electrically connects the line portion 24*a*-2 and the end of the ground conductor 26 that is located on the positive side in the x-axis direction. As a result, the ground conductors 24 and 26 are electrically connected.

The via-hole conductor B15 pierces through the line portion 18*a*-*a* in the section E3 in the z-axis direction, and, when viewed in a plan view in the z-axis direction, it is positioned on the negative side in the y-axis direction relative to the signal line 20. The via-hole conductor B15 electrically connects the line portion 22*a*-2 and the end of the ground conductor 28 that is located on the positive side in the x-axis direction. As a result, the ground conductors 22 and 28 are electrically connected.

The via-hole conductor B16 pierces through the line portion 18*b*-*a* in the section E3 in the z-axis direction, and, when viewed in a plan view in the z-axis direction, it is positioned on the negative side in the y-axis direction relative to the signal line 20. The via-hole conductor B16 electrically connects the line portion 24*a*-2 and the end of the ground conductor 28 that is located on the positive side in the x-axis direction. As a result, the ground conductors 24 and 28 are electrically connected.

The protective layer 14 covers approximately the entire top surface of the dielectric sheet 18*a*. Accordingly, the ground conductor 22 is covered by the protective layer 14. The protective layer 14 is made of, for example, a flexible resin such as a resist material.

Furthermore, the protective layer 14 includes a line portion 14*a* and connecting portions 14*b* and 14*c*, as shown in FIG. 2. The line portion 14*a* covers the entire top surface of the line portion 18*a*-*a*, including the line portions 22*a*-1 and 22*a*-2 provided thereon.

The connecting portion 14*b* is connected to the end of the line portion 14*a* on the negative side in the x-axis direction, so as to cover the top surface of the connecting portion 18*a*-*b*. The connecting portion 14*b* includes openings Ha to Hd provided therein. The opening Ha is a rectangular or substantially rectangular opening positioned approximately at the center of the connecting portion 14*b*. The external terminal 16*a* is exposed to the outside from the opening Ha. The opening Hb is a rectangular or substantially rectangular opening provided on the positive side in the y-axis direction relative to the opening Ha. The opening Hc is a rectangular or substantially rectangular opening provided on the negative side in the x-axis direction relative to the opening Ha. The opening Hd is a rectangular or substantially rectangular opening provided on the negative side in the y-axis direction relative to the opening Ha. The terminal portion 22*b* is exposed to the outside from the openings Hb to Hd, so that the exposed portions serve as external terminals.

The connecting portion 14*c* is connected to the end of the line portion 14*a* on the positive side in the x-axis direction, so as to cover the top surface of the connecting portion 18*a*-*c*. The connecting portion 14*c* has openings He to Hh provided therein. The opening He is a rectangular or substantially rectangular opening positioned approximately at the center of the connecting portion 14*c*. The external terminal 16*b* is exposed to the outside from the opening He. The opening Hf is a rectangular or substantially rectangular opening provided on the positive side in the y-axis direction relative to the opening He. The opening Hg is a rectangular or substantially rectangular opening provided on the positive side in the x-axis direction relative to the opening He. The opening Hh is a rectangular or substantially rectangular opening provided on the negative side in the y-axis direction relative to the opening He. The terminal portion 22*c* is exposed to the outside from the openings Hf to Hh, so that the exposed portions serve as external terminals.

The connectors 100*a* and 100*b* are mounted on the top surfaces of the connecting portions 12*b* and 12*c*, respectively. The connectors 100*a* and 100*b* are configured in the same manner, and therefore, only the configuration of the connector 100*b* will be described below by way of example.

The connector 100*b* includes a connector body 102, external terminals 104 and 106, a center conductor 108, and an external conductor 110, as shown in FIGS. 1, 5A, and 5B. The connector body 102 includes a rectangular or substantially rectangular plate and a cylindrical portion coupled thereon, and is made of an insulating material such as resin.

The external terminal 104 is positioned on the plate of the connector body 102 on the negative side in the z-axis direction, so as to face the external terminal 16*b*. The external terminal 106 is positioned on the plate of the connector body 102 on the negative side in the z-axis direction, so as to correspond to the parts of the terminal portion 22*c* that are exposed from the openings Hf to Hh.

The center conductor 108 is positioned at the center of the cylindrical portion of the connector body 102, and is connected to the external terminal 104. The center conductor 108 is a signal terminal to/from which a high-frequency signal is inputted/outputted. The external conductor 110 is positioned on the inner circumferential surface of the cylindrical portion of the connector body 102, and is connected to the external terminal 106. The external conductor 110 is a ground terminal to be kept at a ground potential.

The connector 100*b* thus configured is mounted on the top surface of the connecting portion 12*c*, such that the external terminal 104 is connected to the external terminal 16*b*, and the external terminal 106 is connected to the terminal portion 22*c*. As a result, the signal line 20 is electrically connected to the center conductor 108. In addition, the ground conductors 22 and 24 are electrically connected to the external conductor 110.

Figure 6A:
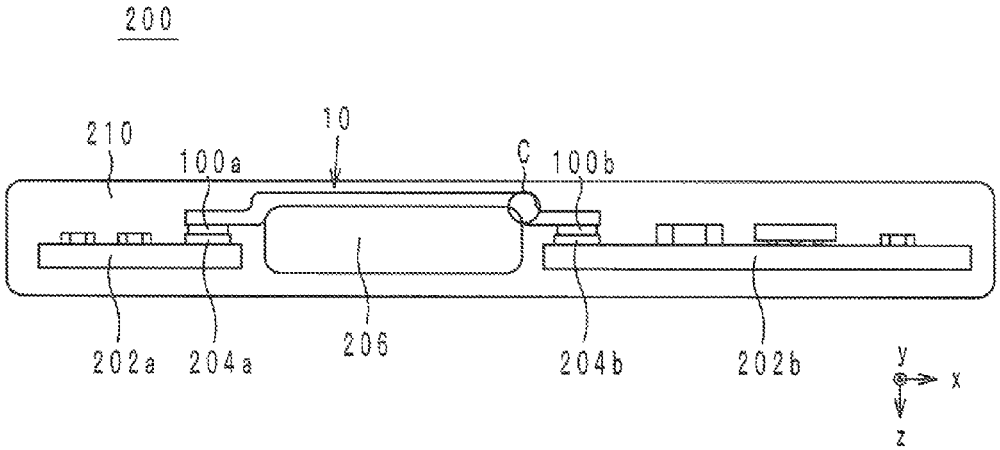
FIGS. 6A and 6B illustrate an electronic device provided with a high-frequency signal line as viewed in plan views in y-axis and z-axis directions, respectively.
Figure 6B:
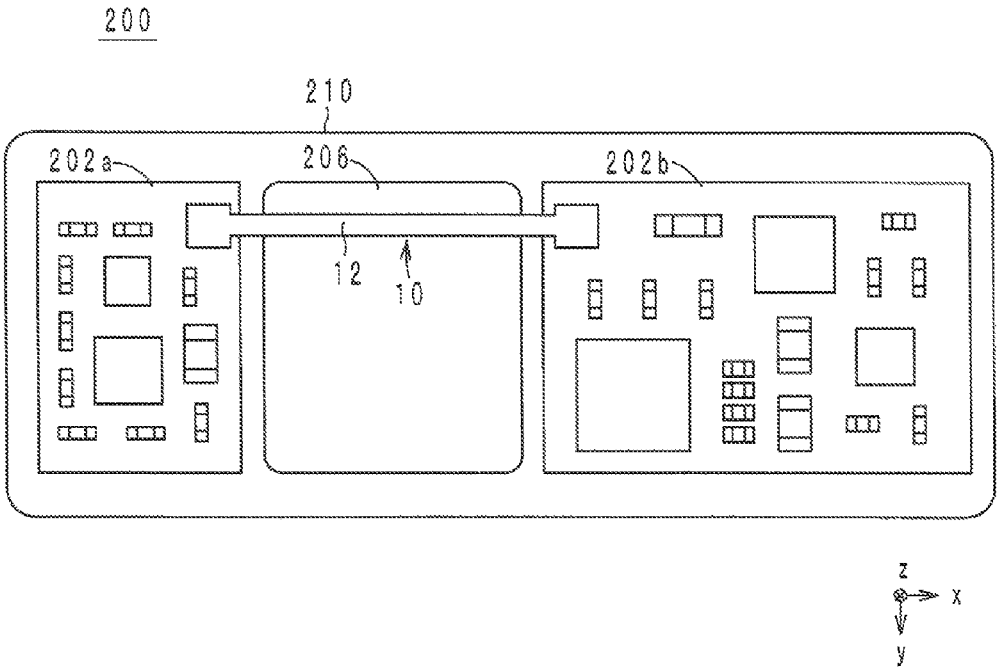
Figure 7:
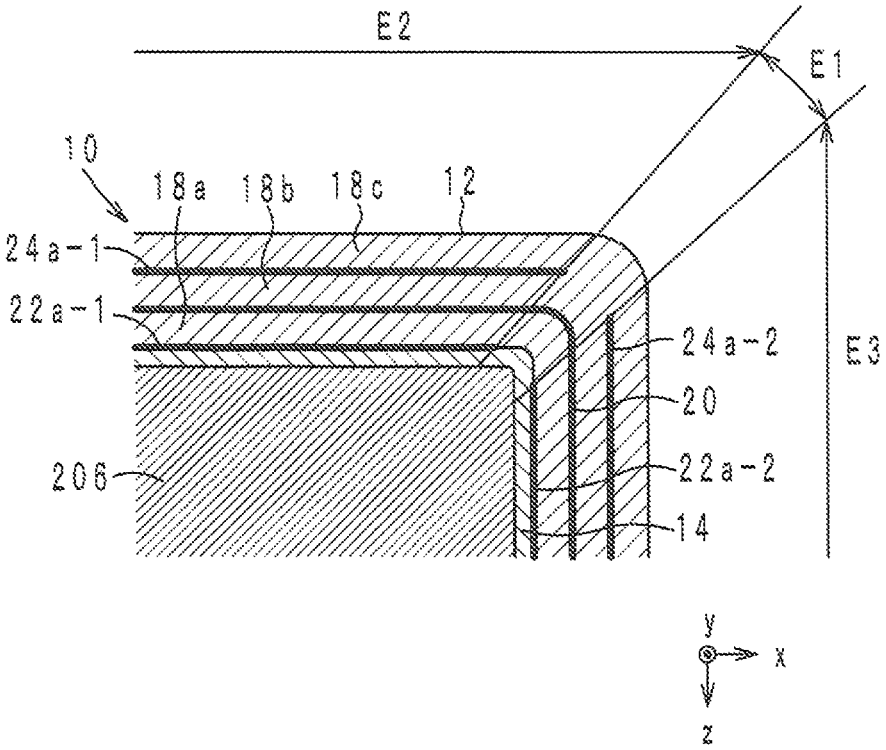
FIG. 7 is a cross-sectional structure view illustrating a circled portion C in FIG. 6A.

The high-frequency signal line 10 thus configured includes the section E1 where neither of the ground conductors 22 and 24 is provided, but there may be more than one such section E1. In the example that will be shown below, the high-frequency signal line 10 is used in an electronic device, and includes two sections E1. FIGS. 6A and 6B illustrate the electronic device 200 provided with the high-frequency signal line 10 as viewed in plan views in the y-axis and z-axis directions, respectively. FIG. 7 is a cross-sectional structure view illustrating a circled portion C in FIG. 6A.

The electronic device 200 includes the high-frequency signal line 10, circuit boards 202*a* and 202*b*, receptacles 204*a* and 204*b*, a battery pack (metallic body) 206, and a housing 210.

The housing 210 accommodates the circuit boards 202*a* and 202*b*, the receptacles 204*a* and 204*b*, and the battery pack 206. For example, the circuit board 202*a* has provided thereon a transmission or reception circuit including an antenna. The circuit board 202*b* has, for example, a power circuit provided thereon. The battery pack 206 is, for example, a lithium-ion secondary battery, and the surface thereof is wrapped by a metal cover. The circuit board 202*a*, the battery pack 206, and the circuit board 202*b* are arranged in this order, from the negative side to the positive side in the x-axis direction.

The receptacles 204*a* and 204*b* are provided on the principal surfaces of the circuit boards 202*a* and 202*b*, respectively, on the negative side in the z-axis direction. The receptacles 204*a* and 204*b* are connected to the connectors 100*a* and 100*b*, respectively. As a result, high-frequency signals to be transmitted between the circuit boards 202*a* and 202*b* at a frequency of, for example, 2 GHz are applied to the center conductors 108 of the connectors 100*a* and 100*b* via the receptacles 204*a* and 204*b*, respectively. Moreover, the external conductors 110 of the connectors 100*a* and 100*b* are kept at a ground potential by the circuit boards 202*a* and 202*b* and the receptacles 204*a* and 204*b*. Thus, the high-frequency signal line 10 connects the circuit boards 202*a* and 202*b*.

Here, the high-frequency signal line 10 is bent in two sections E1, and attached to the surface of the battery pack 206, as shown in FIGS. 6A and 7. The protective layer 14 is fixed to the battery pack 206 by an adhesive or the like, so that the high-frequency signal line 10 is attached to the battery pack 206.

A non-limiting example of a method for producing the high-frequency signal line 10 will be described below with reference to FIG. 2. While the following description focuses on one high-frequency signal line 10 as an example, in actuality, large-sized dielectric sheets are laminated and cut, so that a plurality of high-frequency signal lines 10 are produced at the same time.

Prepared first are dielectric sheets 18 made of a thermoplastic resin and having their entire top surfaces copper-foiled. The copper-foiled top surfaces of the dielectric sheets 18 are smoothened, for example, by galvanization for rust prevention. The dielectric sheets 18 are sheets of liquid crystal polymer preferably having a thickness of about 20 μm to about 80 μm, for example. The thickness of the copper foil preferably is about 10 μm to about 20 μm, for example.

Next, external terminals 16 and a ground conductor 22, as shown in FIG. 2, are formed on the top surface of the dielectric sheet 18*a* by photolithography. Specifically, resists are printed on the copper foil of the dielectric sheet 18*a* in the same patterns as the external terminals 16 (16*a* and 16*b*) and the ground conductor 22 shown in FIG. 2. Then, any portions of the copper foil that are not coated with the resists are removed by etching. Thereafter, the resists are removed. As a result, the external terminals 16 and the ground conductor 22 are formed on the top surface of the dielectric sheet 18*a*, as shown in FIG. 2.

Next, a signal line 20, as shown in FIG. 2, is formed on the top surface of the dielectric sheet 18*b* by photolithography. In addition, a ground conductor 24, as shown in FIG. 2, is formed on the top surface of the dielectric sheet 18*c* by photolithography. Note that the above photolithographic steps are the same as the photolithographic steps for forming the external terminals 16 and the ground conductor 22, and therefore, any descriptions thereof will be omitted.

Next, via-holes are bored through the dielectric sheets 18*a* and 18*b* by irradiating their bottom surfaces with laser beams where via-hole conductors b1, b2, and B1 to B16 are to be formed. Thereafter, the via-holes provided in the dielectric sheets 18*a* and 18*b* are filled with a conductive paste.

Next, the dielectric sheets 18*a* to 18*c* are stacked in this order, from the positive side to the negative side in the z-axis direction, such that the ground conductor 22, the signal line 20, and the ground conductor 24 form a stripline structures. Then, the dielectric sheets 18*a* to 18*c* are heated and pressed from the positive side toward the negative side in the z-axis direction, thus softening the dielectric sheets 18*a* to 18*c* so as to be bonded and integrated, while solidifying the conductive paste in the via-holes, so that the via-hole conductors b1, b2, and B1 to B16 are formed, as shown in FIG. 2. Note that the dielectric sheets 18 may be integrated using an adhesive, such as epoxy resin, rather than by thermocompression bonding. In addition, after the dielectric sheets 18 are integrated, the via-hole conductors b1, b2, and B1 to B16 may be formed by providing via-holes in the dielectric sheets 18 and filling the via-holes with a conductive paste or forming a plated coating over the via-holes.

Lastly, a resin (resist) paste is applied to the dielectric sheet 18*a*, thus forming a protective layer 14 thereon. As a result, the high-frequency signal line 10 shown in FIG. 1 is obtained.

The high-frequency signal line 10 thus configured can be bent for use. More specifically, in an attempt to bend the signal line disclosed in Japanese Patent Laid-Open Publication No. 2011-71403, tensile stress is applied to the ground conductors positioned on the outer circumferential side at the portions that are being bent, and compressive stress is applied to the ground conductors positioned on the inner circumferential side. The ground conductors made of copper foil are resistant to deformation, and therefore, prevent the signal line from being bent in actuality. Moreover, in the case where large tensile stress is applied to the ground conductors, the ground conductors positioned on the outer circumferential side might be broken.

Therefore, in the case of the high-frequency signal line 10, the ground conductors 22 and 24 are not opposed to the signal line 20 in the section E1, which includes a portion of the signal line 20. That is, the ground conductors 22 and 24 do not have any portions provided in the section E1. Accordingly, when the high-frequency signal line 10 is bent in the section E1, the ground conductors 22 and 24, which are positioned on the outer and inner circumferential sides relative to the signal line 20, are not bent. Therefore, the ground conductors 22 and 24 do not inhibit the high-frequency signal line 10 from being bent. In addition, the portions of the ground conductors 22 and 24 that are positioned on the outer circumferential side are inhibited from being broken. Thus, the high-frequency signal line 10 can be readily bent.

Furthermore, in the case of the high-frequency signal line 10, the ground conductors 26 and 28 are provided in the section E1 on the dielectric sheet 18*b* where the signal line 20 is provided, so that the ground conductors 26 and 28 extend along the signal line 20 in the section E1. As a result, in the section E1, the characteristic impedance of the high-frequency signal line 10 is kept at a predetermined characteristic impedance value. In addition, the ground conductors 26 and 28, which are close to the signal line 20, inhibit spurious radiation from the signal line 20.

Here, even when the ground conductors 26 and 28, rather than the ground conductors 22 and 24, are provided in the section E1, as will be described below, the high-frequency signal line 10 can be readily bent. The ground conductors 26 and 28 are provided on the dielectric sheet 18*b* where the signal line 20 is provided. Accordingly, when the high-frequency signal line 10 is bent in the section E1, the ground conductors 26 and 28 are less subject to large compressive stress or large tensile stress. Therefore, the ground conductors 26 and 28 do not significantly inhibit the high-frequency signal line 10 from being bent, so that there is a low possibility that the high-frequency signal line 10 breaks. Thus, the high-frequency signal line 10 can be bent for use.

Furthermore, in the case of the high-frequency signal line 10, the characteristic impedance thereof is inhibited from deviating from a predetermined characteristic impedance value (e.g., about 50Ω) when it is bent. More specifically, in the case of the signal line disclosed in Japanese Patent Laid-Open Publication No. 2011-71403, the ground conductors made of copper foil are less elastic than the dielectric sheets. Accordingly, when the signal line is bent, the ground conductors that are positioned on the outer circumferential side cannot expand sufficiently due to tensile stress. On the other hand, the ground conductors that are positioned on the inner circumferential side cannot contract sufficiently due to compressive stress. Therefore, each dielectric sheet provided between two ground conductors is compressed in the direction of lamination. As a result, the distances between the signal line and the two ground conductors are shortened, so that the characteristic impedance of the signal line deviates from the predetermined characteristic impedance value.

On the other hand, in the case of the high-frequency signal line 10, the ground conductors 22 and 24 do not have any portions provided in the section E1. The ground conductors 26 and 28, rather than the ground conductors 22 and 24, are provided in the section E1 on the dielectric sheet 18*b* where the signal line 20 is provided, so that the ground conductors 26 and 28 extend along the signal line 20 in the section E1. Therefore, when the high-frequency signal line 10 is bent in the section E1, the dielectric sheets 18 are not compressed in the section E1 by the ground conductors 22 and 24. Moreover, even when the high-frequency signal line 10 is bent in the section E1, the distance between the signal line 20 and each of the ground conductors 26 and 28 barely changes because the signal line 20 and the ground conductors 26 and 28 are provided on the same dielectric sheet, i.e., on the dielectric sheet 18*b*. Thus, when the high-frequency signal line 10 is bent, the characteristic impedance thereof is inhibited from deviating from the predetermined characteristic impedance value.

Figure 8:
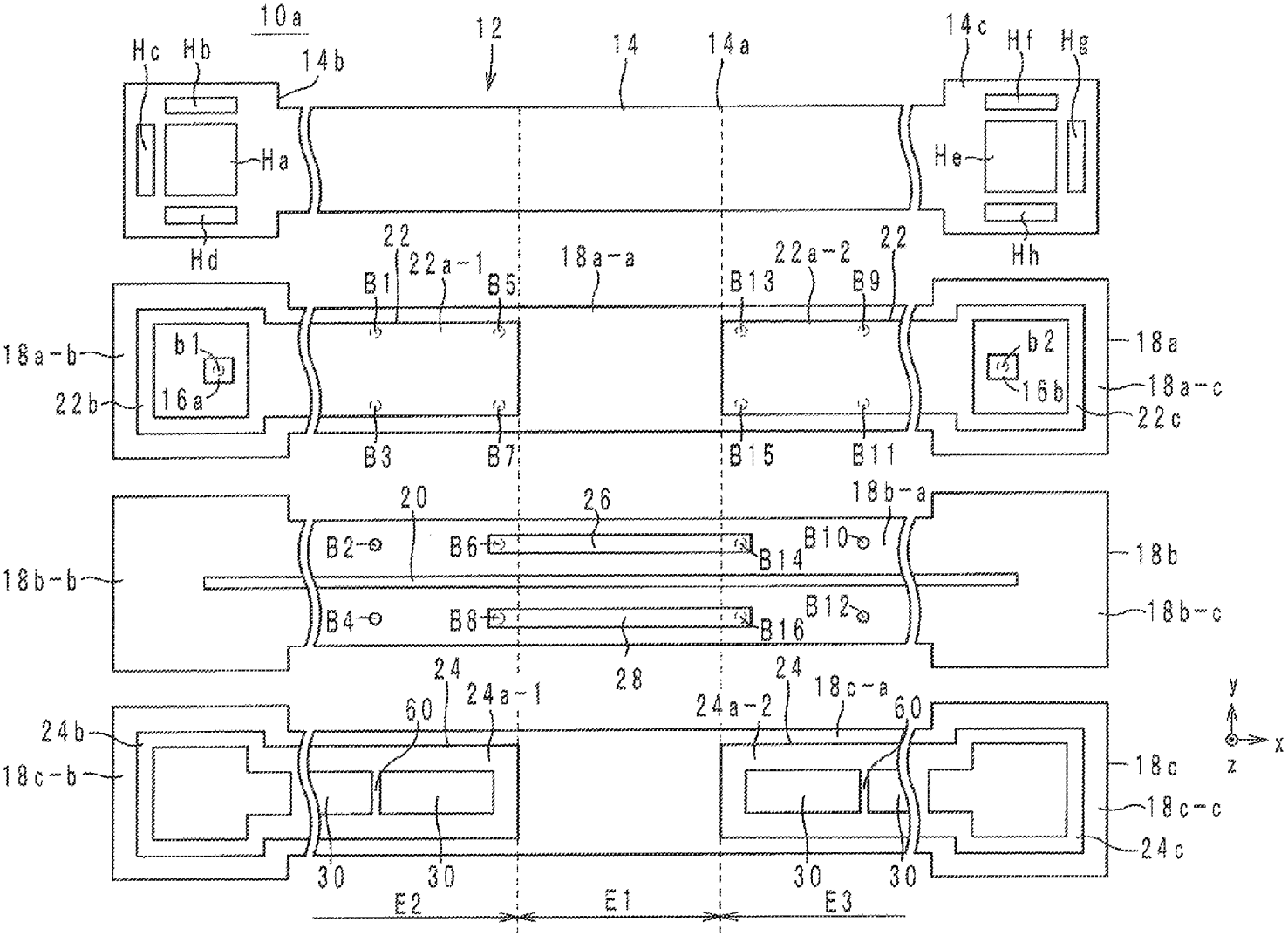
FIG. 8 is an exploded view of a dielectric element assembly of a high-frequency signal line according to a first modification of a preferred embodiment of the present invention.

The configuration of a high-frequency signal line according to a first modification of a preferred embodiment of the present invention will be described below with reference to the drawings. FIG. 8 is an exploded view of a dielectric element assembly 12 of the high-frequency signal line 10*a* according to the first modification.

The high-frequency signal line 10*a* differs from the high-frequency signal line 10 in that openings 30 are provided in the ground conductor 24. More specifically, the high-frequency signal line 10*a* includes line portions 24*a* provided in a ladder-shaped configuration in which the openings 30 having no conductor layer provided therein are arranged along the signal line 20, so as to alternate with bridge portions 60 where a conductor layer is provided. The openings 30 are preferably rectangular or substantially rectangular, and overlap with the signal line 20 when viewed in a plan view in the z-axis direction, as shown in FIG. 8. Accordingly, the signal line 20, when viewed in a plan view in the z-axis direction, overlaps alternatingly with the openings 30 and the bridge portions 60. In addition, the openings 30 are arranged at equal or substantially equal intervals.

Here, the characteristic impedance of the high-frequency signal line 10*a* is determined mainly by the opposed areas of the signal line 20 and the ground conductor 22, which serves as a reference ground conductor, and the distance therebetween, as well as by the relative permittivities of the dielectric sheets 18*a* to 18*c*. Therefore, in the case where the characteristic impedance of the high-frequency signal line 10*a* is to be set to 50Ω, for example, the characteristic impedance of the high-frequency signal line 10*a* is designed to become 55Ω, for example, slightly higher than the 50Ω, because of the influence of the signal line 20 and the reference ground conductor 22. Moreover, the ground conductor 24, which serves as an auxiliary ground conductor as will be described later, is shaped such that the characteristic impedance of the high-frequency signal line 10*a* becomes 50Ω because of the influence of the signal line 20, the reference ground conductor 22, and the auxiliary ground conductor 24.

The auxiliary ground conductor 24 is a ground conductor that doubles as a shield. Moreover, the auxiliary ground conductor 24 is designed to make final adjustments such that the characteristic impedance of the high-frequency signal line 10*a* is set to 50Ω, as described above. In addition, the interval between the bridge portions 60 of the auxiliary ground conductor 24 in the x-axis direction is designed such that radiation noise does not occur within a frequency band to be used. In the following, the principal surface of the auxiliary ground conductor 24 that is located on the positive side in the z-axis direction will be referred to as a top surface, and the principal surface of the auxiliary ground conductor 24 that is located on the negative side in the z-axis direction will be referred to as a bottom surface.

In the case of the high-frequency signal line 10*a* thus configured, the ground conductor 24 has the openings 30 provided therein, and therefore, are susceptible to deformation. In the case of the high-frequency signal line 10, the impedance thereof is required to be set to a predetermined impedance value (e.g., 50Ω) in both of the sections E2 and E3, and therefore, the dielectric sheets 18 can be thinned only to a limited extent, because it is necessary to prevent an increase in the value of floating capacitances created between the signal line 20 and the ground conductors 22 and 24.

On the other hand, in the case of the high-frequency signal line 10*a*, the openings 30 are provided so that the value of the floating capacitance between the ground conductor 24 and the signal line 20 decreases, which allows the dielectric sheets 18 to be thinner. As a result, the high-frequency signal line 10*a* can be bent more readily. In addition, providing the openings 30 renders it possible to increase the width of the signal line 20 in the y-axis direction, resulting in a reduced high-frequency resistance value.

Second Modification

Figure 9:
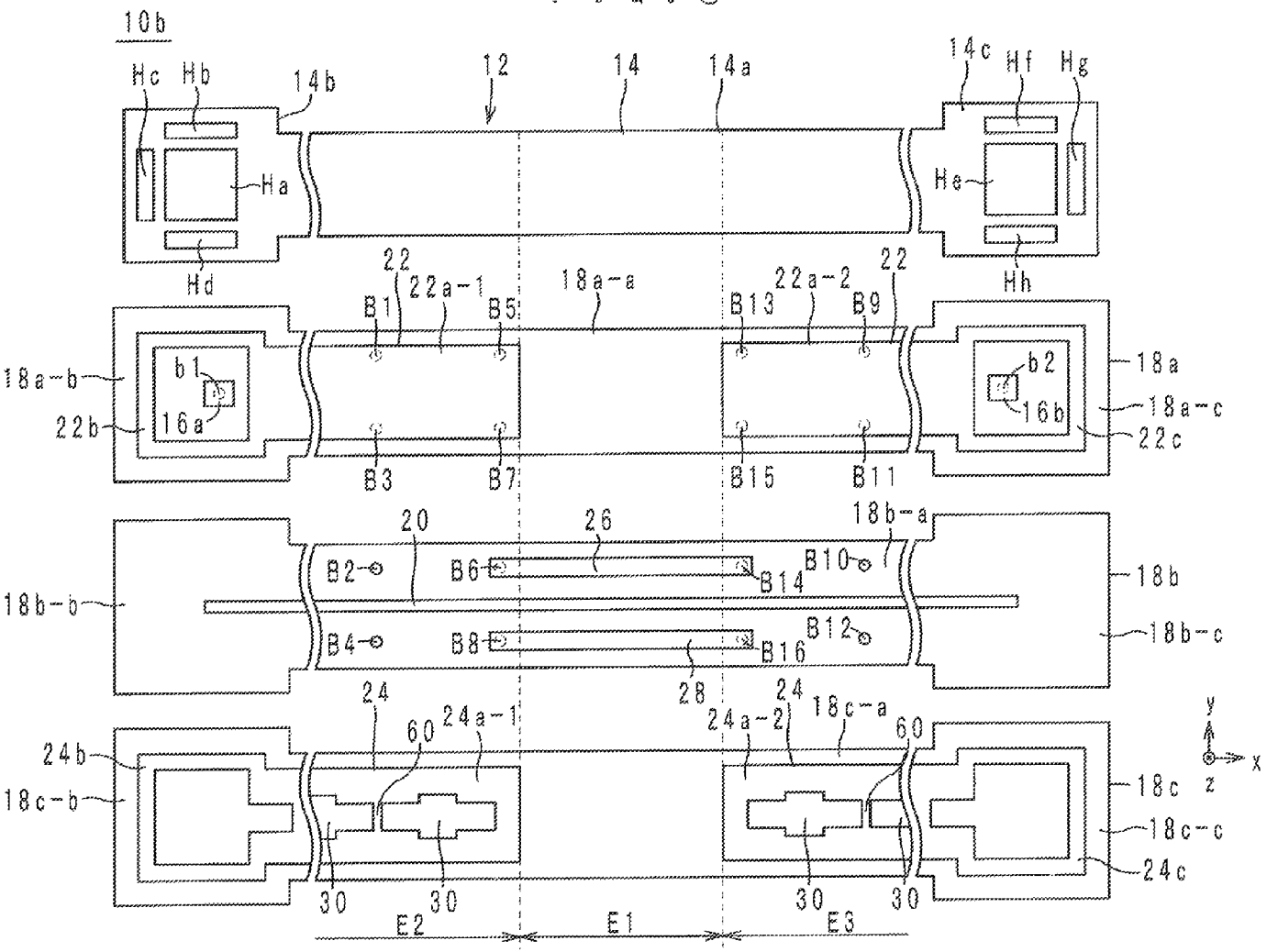
FIG. 9 is an exploded view of a dielectric element assembly of a high-frequency signal line according to a second modification of a preferred embodiment of the present invention.

The configuration of a high-frequency signal line according to a second modification of a preferred embodiment of the present invention will be described below with reference to the drawings. FIG. 9 is an exploded view of a dielectric element assembly 12 of the high-frequency signal line 10*b* according to the second modification.

The high-frequency signal line 10*b* differs from the high-frequency signal line 10*a* in terms of the shape of the openings 30. The configuration of the high-frequency signal line 10*b* will be described below, mainly focusing on the difference.

The high-frequency signal line 10*b* has a ground conductor 24 provided in a ladder-shaped configuration in which the openings 30 are provided along the signal line 20, so as to alternate with the bridge portions 60. Note that the openings 30, when viewed in a plan view in the z-axis direction, have a cross-shaped configuration, as shown in FIG. 9.

In the case of the high-frequency signal line 10*b* thus configured, the width of the opening 30 in the y-axis direction is narrow at opposite ends in the x-axis direction, and wide at the center in the x-axis direction (i.e., at and around the center of the opening 30). Accordingly, strong magnetic fields generated by current flowing through the signal line 20 are less likely to be transmitted directly to the bridge portions 60. As a result, the ground potential of the bridge portions 60 is stabilized, so that the shielding effectiveness of the ground conductor 24 is maintained. Therefore, spurious radiation is inhibited from being generated. Thus, in the case of the high-frequency signal line 10*b*, even when the distance between the signal line 20 and each of the ground conductors 22 and 24 is reduced, it is possible to keep spurious radiation from the signal line 20 low while maintaining a predetermined characteristic impedance value. Moreover, the high-frequency signal line 10*b* can be rendered thinner, and therefore, can be bent more readily. In addition, providing the openings 30 renders it possible to increase the width of the signal line 20 in the y-axis direction, resulting in a reduced high-frequency resistance value.

Third Modification

Figure 10:
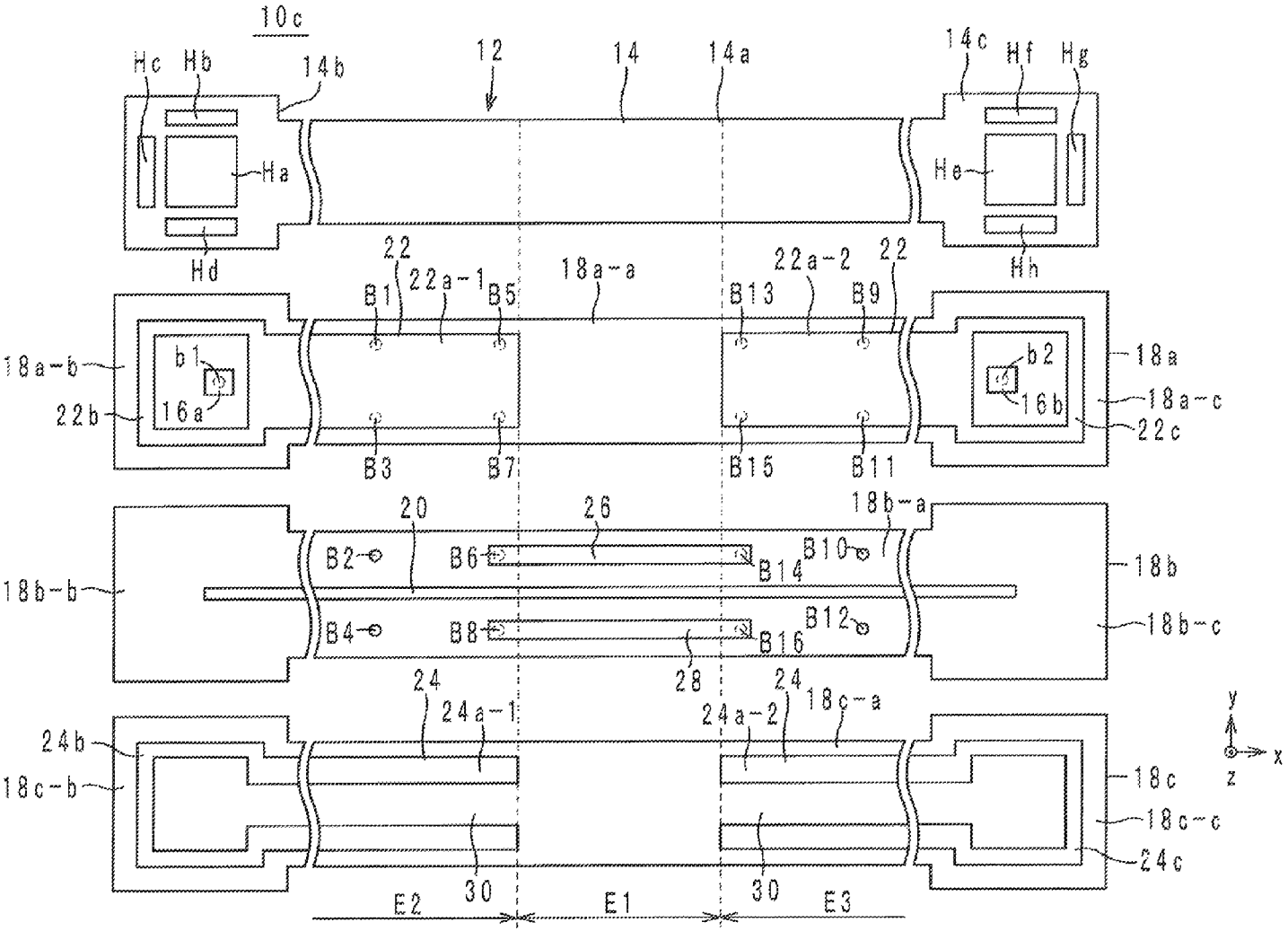
FIG. 10 is an exploded view of a dielectric element assembly of a high-frequency signal line according to a third modification of a preferred embodiment of the present invention.

The configuration of a high-frequency signal line according to a third modification of a preferred embodiment of the present invention will be described below with reference to the drawings. FIG. 10 is an exploded view of a dielectric element assembly 12 of the high-frequency signal line 10*c* according to the third modification.

The high-frequency signal line 10*c* differs from the high-frequency signal line 10*a* in terms of the shape of the openings 30. The openings 30 of the high-frequency signal line

10*c* have slit shapes extending in the x-axis direction. That is, the high-frequency signal line 10*c* is not provided with the bridge portions 60.

Since the high-frequency signal line 10*c* thus configured is provided with the openings 30, the ground conductor 24 is susceptible to deformation. As a result, the high-frequency signal line 10*c* can be readily bent for use. Moreover, the ground conductor 24 does not overlap with the signal line 20 in any sections, and therefore, the signal line 20 can be widened. Thus, transmission loss in the signal line 20 can be reduced.

Fourth Modification

Figure 11:
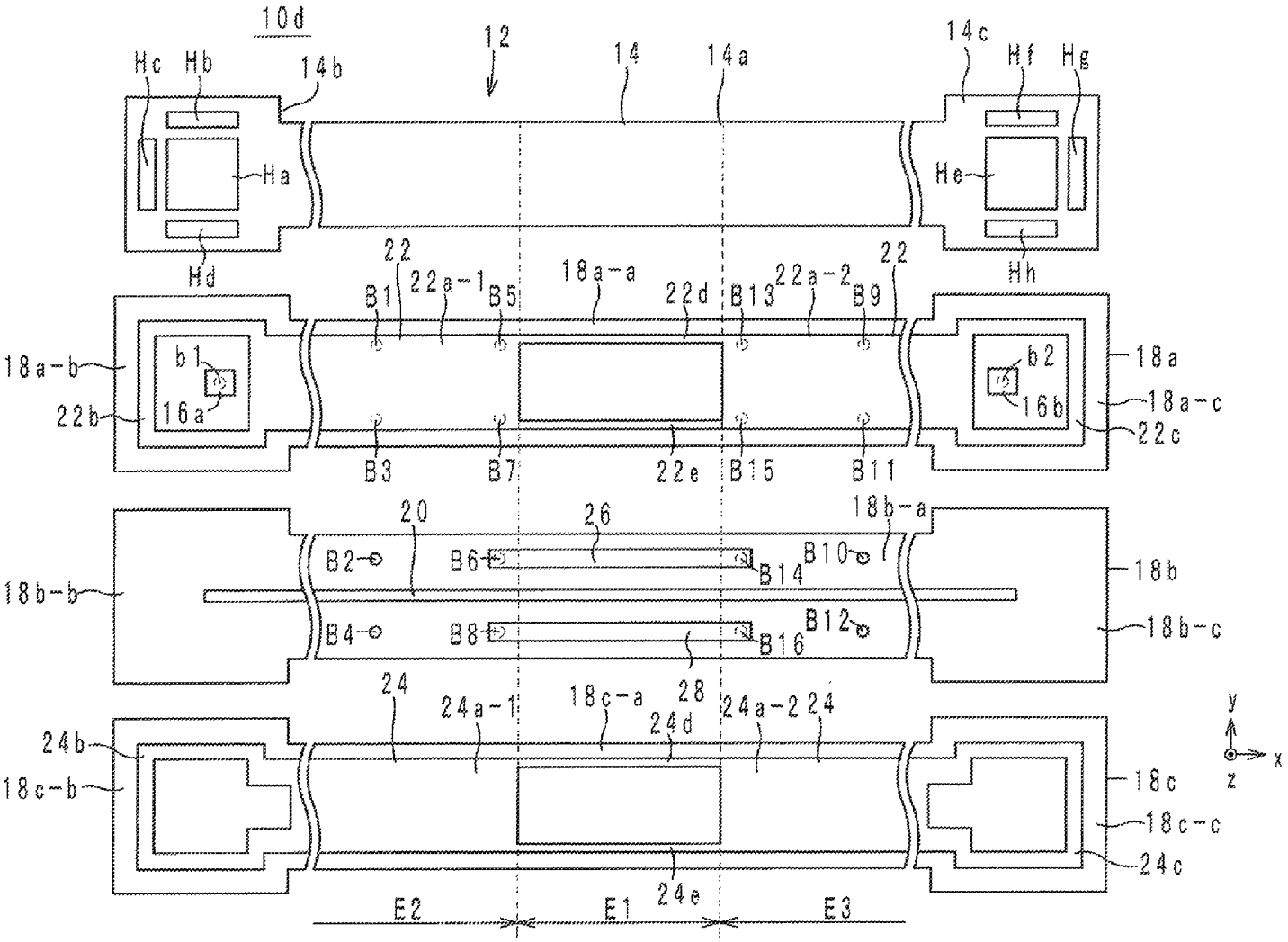
FIG. 11 is an exploded view of a dielectric element assembly of a high-frequency signal line according to a fourth modification of a preferred embodiment of the present invention.

The configuration of a high-frequency signal line according to a fourth modification of a preferred embodiment of the present invention will be described below with reference to the drawings. FIG. 11 is an exploded view of a dielectric element assembly 12 of the high-frequency signal line 10*d* according to the fourth modification.

The high-frequency signal line 10*d* differs from the high-frequency signal line 10 in that connecting portions (connecting conductor portions) 22*d*, 22*e*, 24*d*, and 24*e* are additionally provided.

The ground conductor 22 of the high-frequency signal line 10*d* includes the additional connecting portions 22*d* and 22*e*. Moreover, the ground conductor 24 includes the additional connecting portions 24*d* and 24*e*.

The connecting portions 22*d* and 22*e* are narrower than the width of each of line portions 22*a*-1 and 22*a*-2 in the y-axis direction, and span the section E1 in the x-axis direction. Note that the connecting portions 22*d* and 22*e*, when viewed in a plan view in the z-axis direction, do not overlap with the signal line 20. Moreover, each of the connecting portions 22*d* and 22*e* connects the line portions 22*a*-1 and 22*a*-2. From the viewpoint of facilitating the bending of the high-frequency signal line 10*d*, the connecting portions 22*d* and 22*e*, when viewed in a plan view, do not overlap with the ground conductors 26 and 28 in the section E1.

Furthermore, the connecting portions 24*d* and 24*e* are thinner than the width of each of the line portions 24*a*-1 and 24*a*-2 in the y-axis direction, and span the section E1 in the x-axis direction. Note that the connecting portions 24*d* and 24*e*, when viewed in a plan view in the z-axis direction, do not overlap with the signal line 20. Moreover, each of the connecting portions 24*d* and 24*e* connects the line portions 24*a*-1 and 24*a*-2. From the viewpoint of facilitating the bending of the high-frequency signal line 10*d*, the connecting portions 24*d* and 24*e*, when viewed in a plan view, do not overlap with the ground conductors 26 and 28 in the section E1.

As in the high-frequency signal line 10*d*, the connecting portions 22*d*, 22*e*, 24*d*, and 24*e* can be provided in the section E1. However, the connecting portions 22*d*, 22*e*, 24*d*, and 24*e* preferably have a width such that the high-frequency signal line 10*d* is not significantly inhibited from being bent in the section E1, and, for example, they are preferably thinner than the width of each of the line portions 22*a*-1 and 22*a*-2 in the y-axis direction.

In the high-frequency signal line 10*d*, the line portions 22*a*-1 and 22*a*-2 are electrically connected, and therefore, the potential of the ground conductor 22 is maintained stably at the ground potential. Likewise, the line portions 24*a*-1 and 24*a*-2 are electrically connected, and therefore, the potential of the ground conductor 24 is maintained stably at the ground potential.

Fifth Modification

Figure 12:
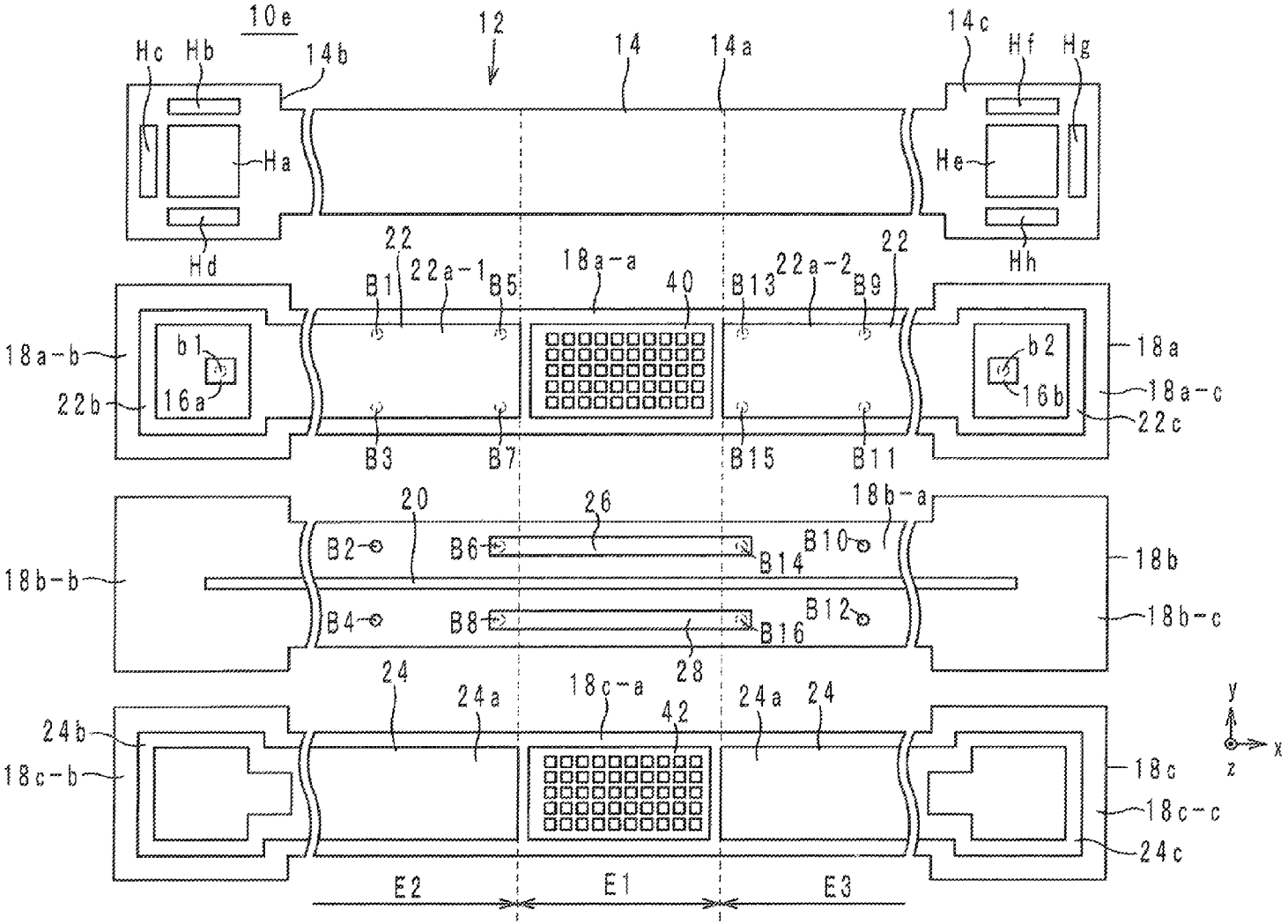
FIG. 12 is an exploded view of a dielectric element assembly of a high-frequency signal line according to a fifth modification of a preferred embodiment of the present invention.

The configuration of a high-frequency signal line according to a fifth modification of the present invention will be described below with reference to the drawings. FIG. 12 is an exploded view of a dielectric element assembly 12 of the high-frequency signal line 10*e* according to the fifth modification.

The high-frequency signal line 10*e* differs from the high-frequency signal line 10 in that floating conductors 40 and 42 are provided.

In the high-frequency signal line 10*e*, the floating conductors 40 and 42 are mesh-shaped conductors having a number of openings and opposed to the signal line 20 in the section E1, and further, the floating conductors 40 and 42 are not electrically connected to the ground conductors 22 and 24 and the signal line 20. Specifically, the floating conductor 40 is provided on the top surface of the dielectric sheet 18*a* in the section E1, and is not connected to the ground conductor 22. Moreover, the floating conductor 42 is provided on the top surface of the dielectric sheet 18*c* in the section E1, and is not connected to the ground conductor 24. Therefore, the floating conductor 42 is at a floating potential.

In the case where the high-frequency signal line 10*e* thus configured is used in the electronic device 200, the characteristic impedance in the section E1 is restrained from deviating from a predetermined characteristic impedance value. More specifically, when the high-frequency signal line 10 is used in the electronic device 200, there are no conductors, such as ground conductors, provided between the signal line 20 and the battery pack 206 in the section E1, as shown in FIG. 7. Accordingly, there is a possibility that the signal line 20 and the battery pack 206 might be capacitively coupled, causing the characteristic impedance of the high-frequency signal line 10 to deviate from the predetermined characteristic impedance value.

Therefore, the high-frequency signal line 10*e* is provided with the floating conductors 40 and 42. The floating conductor 40 is disposed between the signal line 20 and the battery pack 206. As a result, the signal line 20 and the battery pack 206 are restrained from being capacitively coupled, so that the characteristic impedance of the high-frequency signal line 10 is inhibited from deviating from the predetermined characteristic impedance value.

Furthermore, in the high-frequency signal line 10*e*, the signal line 20 overlaps with the floating conductors 40 and 42, and therefore, electric fields generated by the signal line 20 are inhibited from being unnecessarily radiated from the high-frequency signal line 10*e*.

Note that the floating conductors 40 and 42 should not significantly inhibit the high-frequency signal line 10 from being bent in the section E1. Therefore, the floating conductors 40 and 42 are preferably conductor layers that are provided with openings so as to be deformed relatively with ease, rather than solid conductor layers without openings.

Furthermore, to ensure bendability, conductor density (the total area of the region where a conductor is located/the total area of the dielectric sheet) of the dielectric sheet 18 in the section E1 needs to be lower when compared to the sections E2 and E3.

Other Preferred Embodiments

The present invention is not limited to the high-frequency signal lines 10 and 10*a* to 10*e* according to the above preferred embodiment, and variations can be made within the spirit and scope of the present invention.

The high-frequency signal lines 10 and 10*a* to 10*e* are preferably provided with the protective layers 14, but additional layers of dielectric sheet 18 may be provided in place of the protective layers 14.

Furthermore, each of the high-frequency signal lines 10 and 10*a* to 10*e* may have the signal line 20 and the ground conductors 26 and 28 provided on the top surface of the dielectric sheet 18*b*, and the ground conductor 24 provided on the bottom surface of the dielectric sheet 18*b*. As a result, the high-frequency signal lines 10 and 10*a* to 10*e* can be produced using only two layers of dielectric sheet 18. Moreover, the signal line 20 and the ground conductor 24 are preferably located on the same dielectric sheet, i.e., the dielectric sheet 18*b*, and therefore, the positional relationship between the signal line 20 and the ground conductor 24 is not changed by the dielectric sheets 18*a* and 18*b* deviating from each other at the time of lamination.

Furthermore, only one of the ground conductors 26 and 28 may be provided. However, from the viewpoint of adjustments in the characteristic impedance of the signal line 20 and reduction in spurious radiation from the signal line 20, both of the ground conductors 26 and 28 are preferably provided.

Furthermore, the ground conductors 26 and 28 are not opposed to the ground conductor 22 in the section E1. However, the ground conductors 26 and 28 may be opposed to the ground conductor 22 so long as they are not opposed at least in part to the ground conductor 22 in the section E1. Therefore, in the high-frequency signal line 10*d*, the ground conductors 26 and 28 may overlap in part with the connecting portions 22*d* and 22*e* in the section E1. However, in the case where the ground conductor 22 overlaps with the ground conductors 26 and 28, the high-frequency signal line 10*d* might be more difficult to be bent. It is preferable that the ground conductor 22, when viewed in a plan view in the z-axis direction, does not overlap with the ground conductors 26 and 28 in the section E1.

Note that the high-frequency signal line 10 is preferably bent with the top surface down, as shown in FIG. 7, but it may be bent with the bottom surface down.

Furthermore, the high-frequency signal lines 10 and 10*a* to 10*e* may include more than one section E1.

Furthermore, the high-frequency signal lines 10 and 10*a* to 10*e* may be used on RF circuit boards such as antenna front end modules.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A high-frequency signal line comprising:

an element assembly including a plurality of flexible insulator layers;

a linear signal line provided in or on the element assembly;

a first ground conductor provided in or on the element assembly, so as to be opposed to the signal line not in a first section including a portion of the signal line but in a second section adjacent to the first section;

a second ground conductor provided along the signal line in the first section on the insulator layer on which the signal line is provided;

a third ground conductor provided along the signal line in the first section on the insulator layer on which the signal line is provided, such that the signal line is positioned between the second and third ground conductors; and a fourth ground conductor provided in or on the element assembly, so as to be opposite to the first ground conductor with the signal line positioned therebetween, without being opposed to the signal line in the first section; wherein the second ground conductor is not opposed at least in part to the first ground conductor in the first section; and the third ground conductor is not opposed at least in part to the first ground conductor in the first section.

2. The high-frequency signal line according to claim 1, wherein the second and third ground conductors are electrically connected to the first and fourth ground conductors.

3. The high-frequency signal line according to claim 1, wherein the first and second ground conductors are electrically connected by via-hole conductors.

4. The high-frequency signal line according to claim 1, wherein the element assembly is bent in the first section.

5. The high-frequency signal line according to claim 1, wherein the first ground conductor is substantially not provided in the first section.

6. The high-frequency signal line according to claim 1, wherein the first ground conductor includes:

first and second ground conductor portions respectively provided in the second section and a third section positioned across the first section from the second section; and a connecting conductor portion connecting the first and second ground conductor portions and being narrower than each of the first and second ground conductor portions.

7. A high-frequency signal line comprising:

an element assembly including a plurality of flexible insulator layers;

a linear signal line provided in or on the element assembly;

a first ground conductor provided in or on the element assembly, so as to be opposed to the signal line not in a first section including a portion of the signal line but in a second section adjacent to the first section;

a second ground conductor provided along the signal line in the first section on the insulator layer on which the signal line is provided; and a floating conductor opposed to the signal line in the first section and having openings provided therein; wherein the second ground conductor is not opposed at least in part to the first ground conductor in the first section; and the floating conductor is not electrically connected to the first ground conductor and the signal line.

8. The high-frequency signal line according to claim 7, wherein the first and second ground conductors are electrically connected by via-hole conductors.

9. The high-frequency signal line according to claim 7, wherein the element assembly is bent in the first section.

10. The high-frequency signal line according to claim 7, wherein the first ground conductor is substantially not provided in the first section.

11. An electronic device comprising:

a housing; and a high-frequency signal line accommodated in the housing; wherein the high-frequency signal line includes:

an element assembly including a plurality of flexible insulator layers;

a linear signal line provided in or on the element assembly;

a first ground conductor provided in or on the element assembly, so as to be opposed to the signal line not in a first section including a portion of the signal line but in a second section adjacent to the first section;

a second ground conductor provided along the signal line in the first section on the insulator layer on which the signal line is provided;

a third ground conductor provided along the signal line in the first section on the insulator layer on which the signal line is provided, such that the signal line is positioned between the second and third ground conductors; and a fourth ground conductor provided in or on the element assembly, so as to be opposite to the first ground conductor with the signal line positioned therebetween, without being opposed to the signal line in the first section;

the second ground conductor is not opposed at least in part to the first ground conductor in the first section; and the third ground conductor is not opposed at least in part to the first ground conductor in the first section.

12. The electronic device according to claim 11, wherein the second and third ground conductors are electrically connected to the first and fourth ground conductors.

13. The electronic device according to claim 11, wherein the first and second ground conductors are electrically connected by via-hole conductors.

14. The electronic device according to claim 11, wherein the element assembly is bent in the first section.

15. The electronic device according to claim 11, wherein the first ground conductor is substantially not provided in the first section.

16. The electronic device according to claim 11, wherein the first ground conductor includes:

first and second ground conductor portions respectively provided in the second section and a third section positioned across the first section from the second section; and a connecting conductor portion connecting the first and second ground conductor portions and being narrower than each of the first and second ground conductor portions.

17. An electronic device comprising:

a housing; and a high-frequency signal line accommodated in the housing; wherein the high-frequency signal line includes:

an element assembly including a plurality of flexible insulator layers;

a linear signal line provided in or on the element assembly;

a first ground conductor provided in or on the element assembly, so as to be opposed to the signal line not in a first section including a portion of the signal line but in a second section adjacent to the first section;

a second ground conductor provided along the signal line in the first section on the insulator layer on which the signal line is provided; and a floating conductor opposed to the signal line in the first section and having openings provided therein; wherein the second ground conductor is not opposed at least in part to the first ground conductor in the first section; and the floating conductor is not electrically connected to the first ground conductor and the signal line.

18. The electronic device according to claim 17, wherein the first and second ground conductors are electrically connected by via-hole conductors.

19. The electronic device according to claim 17, wherein the element assembly is bent in the first section.

20. The electronic device according to claim 17, wherein the first ground conductor is substantially not provided in the first section.

* * * * *